US006968925B1

(12) United States Patent
Miyoshi et al.

(10) Patent No.: US 6,968,925 B1
(45) Date of Patent: Nov. 29, 2005

(54) ELEVATOR APPARATUS

(75) Inventors: Hiroyuki Miyoshi, Mie (JP); Takashi Kuga, Mie (JP)

(73) Assignee: Teijin Seiki Co., Ltd, Tokyo (JP)

( * ) Notice: Subject to any disclaimer, the term of this patent is extended or adjusted under 35 U.S.C. 154(b) by 0 days.

(21) Appl. No.: 09/629,277

(22) Filed: Jul. 31, 2000

(30) Foreign Application Priority Data

Aug. 3, 1999 (JP) ..... 11-219490

(51) Int. Cl.[7] ..... B66B 11/08

(52) U.S. Cl. ..... 187/254; 187/289; 254/342; 310/83

(58) Field of Search ..... 187/254, 289; 254/342; 310/83

(56) References Cited

U.S. PATENT DOCUMENTS

| | | | | | |
|---|---|---|---|---|---|
| 4,172,509 | A | * | 10/1979 | Miyagi et al. | 187/1 R |
| 4,600,086 | A | * | 7/1986 | Yamasaki et al. | 187/27 |
| 4,766,977 | A | * | 8/1988 | Yamasaki | 187/20 |
| 5,018,603 | A | * | 5/1991 | Ito | 187/17 |
| 5,469,937 | A | * | 11/1995 | Hakala et al. | 187/266 |
| 6,202,793 | B1 | * | 3/2001 | Fargo | 187/277 |
| 6,230,844 | B1 | * | 5/2001 | Latorre | 187/254 |
| 6,520,483 | B1 | * | 2/2003 | Miyoshi et al. | |
| 6,578,672 | B1 | * | 6/2003 | Miyoshi | |

FOREIGN PATENT DOCUMENTS

| | | | | |
|---|---|---|---|---|
| CN | 1040557 A | | 3/1990 | |
| EP | 0 680 920 A3 | | 11/1995 | |
| EP | 719724 | * | 7/1996 | |
| EP | 0 834 463 A1 | | 4/1998 | |
| GB | 2201657 | * | 9/1988 | |
| JP | A-58-16375 | | 10/1983 | |
| JP | A-59-40276 | | 3/1984 | |
| JP | 1-220690 | * | 9/1989 | 187/413 |
| JP | 2-70689 | * | 3/1990 | |
| JP | 8-40675 | * | 2/1996 | |
| JP | 8-169671 | * | 7/1996 | |
| JP | 11-79627 | * | 3/1999 | |

OTHER PUBLICATIONS

U.S. Appl. No. 09/629,276, filed Jul. 2000, Miyoshi et al.*

* cited by examiner

*Primary Examiner*—Thomas J. Brahan
(74) *Attorney, Agent, or Firm*—Akin Gump Strauss Hauer & Feld, LLP

(57) ABSTRACT

An elevator apparatus has an actuating device including a sheave around which a rope engaged with an ascending and descending cage is wound and a driving section for rotating the sheave. The sheave is adapted to rotate to move the rope with its rotation. The actuating device is installed in a machine room provided on a top floor of a building in which the ascending and descending cage is disposed. The machine room faces with an elevator passage for the cage.

22 Claims, 2 Drawing Sheets

ELEVATOR APPARATUS

BACKGROUND OF THE INVENTION

The present invention relates to an elevator apparatus for moving an ascending and descending cage of an elevator upward and downward.

Recently, comparatively tall buildings relative to areas of grounds have been often built, because there are many cases where the grounds are limited in a city and the like. In such a tall building, an elevator is particularly required to ascend to high floors, and it is a problem how this elevator should be installed. Although an elevator passage through which the ascending and descending cage of the elevator passes must be provided in a manner a passing through respective floors, an actuating device for moving the elevator upward and downward can be installed at an optional position to some degree.

By the way, it is disclosed in Japanese Publication of unexamined Utility Model Application No. JP-A-59-40276U, for example, that the actuating device is provided below the elevator passage or at a side of the elevator passage at an intermediate part thereof. However, in such a structure, there has been a problem that a first and a second rope pulleys are required to be provided in an upper part of the elevator passage in order to transmit a power from the actuating device to the ascending and descending cage by way of the rope, which incurs a complexity of the structure and an increase of the cost.

In such a prior art, there has been another problem that in the structure in which the actuating device is provided below the elevator passage, an underground room having a size for accommodating the actuating device must be provided underground, and the cost will be further increased. Moreover, there has been a further problem that in case a determined amount of space is provided above the elevator passage for a fear of an overrun of the ascending and descending cage, and rope pulleys are mounted in the upper part of the elevator passage, a ceiling of the top floor of the building will be higher.

On the other hand, Japanese Publication of unexamined Patent Application No. JP-A-58-16375 discloses that a machine room is provided at a side of the elevator passage on the top floor of the building to install the actuating device for the elevator in the machine room. However, such a structure has also a problem that four deflecting sheaves are required above the ascending and descending cage, which incurs a complexity of the structure and an increase of the cost, similarly to the above described prior art. Moreover, the machine room having a large floor area for the actuating device is required.

SUMMARY OF THE INVENTION

In view of the above described problems, it is an object of the invention to provide such an elevator apparatus that the cost for installing the elevator can be kept low, and that effective spaces are secured in the building.

In order to attain the above described object, there is provided, according to the invention, an elevator apparatus which comprises an actuating device including a sheave around which a rope engaged with an ascending and descending cage is wound, the sheave being adapted to rotate thereby to move the rope, and a driving section for rotating the sheave. The actuating device is installed in a machine room provided on a top floor of a building in which the ascending and descending cage is disposed. The machine room faces with an elevator passage for the ascending and descending cage.

According to the elevator apparatus of the invention, because the actuating device is installed in the machine room provided on the top floor of the building in which the ascending and descending cage is disposed, and the machine room faces with the elevator passage for the ascending and descending cage, the elevator apparatus can be constructed in a smaller space and composed of less components, without employing the rope pulleys or the deflecting sheaves as in the prior art. Accordingly, the cost can be lowered. It is no more necessary that the ceiling of the top floor is set high unnecessarily. Further, because a height of the machine room is low, an effective space on the top floor of the building can be secured.

The present disclosure relates to the subject matter contained in Japanese patent application No. Hei. 11-219490 (filed on Aug. 3, 1999), which is expressly incorporated herein by reference in its entirety.

DESCRIPTION OF THE PREFERRED EMBODIMENT

Figure 1:
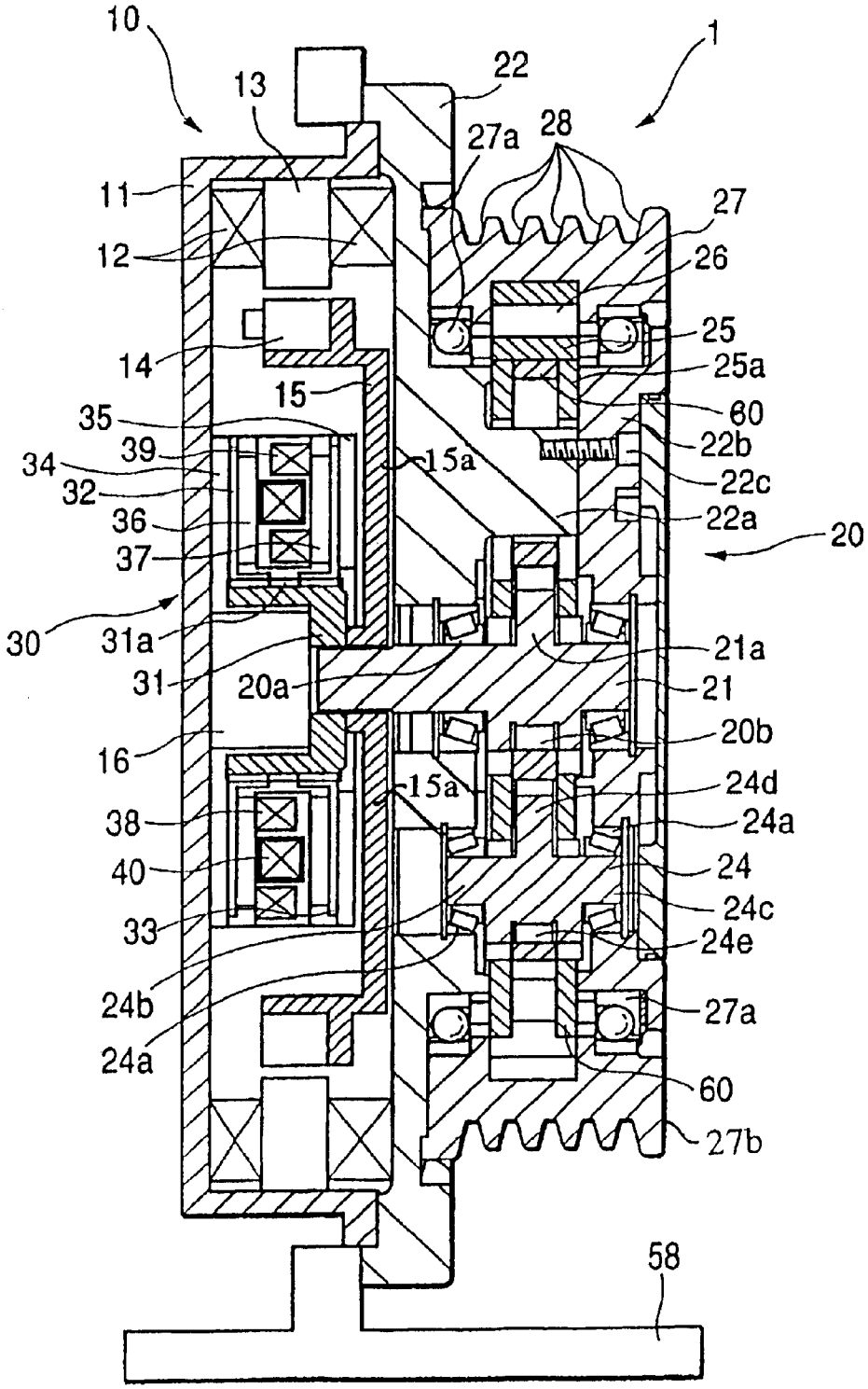
FIG. 1 is a sectional side view of an actuating device for an elevator illustrating an embodiment according to the invention.

Hereunder, a mode for carrying out the invention will be described referring to the drawings. FIG. 1 is a sectional side view of an actuating device 1 for an elevator illustrating an embodiment according to the invention.

As shown in FIG. 1, the actuating device 1 for the elevator includes a motor assembly 10, a speed-reducer 20 adapted to reduce rotation speed of an input shaft 21 which is driven to rotate by means of the motor assembly 10 to transmit the rotation, and a brake assembly 30.

The motor assembly 10 has, in a housing 11 of the motor assembly 10, a coil 12, a stator 13 disposed adjacent to the coil 12, a rotor 14, a rotary disc 15 fixed to the rotor 14 and having its center part splinedly connected to the input shaft 21 to rotate therewith. An encoder 16 detects a number of rotations of the input shaft 21. The housing 11 is fixed to a support member 22 of the speed-reducer 20. The rotary disc 15 includes a support web 15*a* that extends radially from the input shaft 21 and is positioned in facing relationship to a side of the support member 22 facing the motor assembly 10. The support member 22 is attached to a floor face of a machine room 58 of a building 50 which will be described later. The motor assembly 10 is so constructed that an electrical supply to the coil 12 is controlled by a control section which is not shown, whereby a determined amount of torque is outputted.

As shown in FIG. 1, the speed-reducer 20 includes the input shaft 21 which is rotatably supported by a bearing 20*a* at a center part of the support member 22 (a rotation center of the speed-reducer). A sheave 27 is attached to the speed-reducer 20 as an output rotary wheel which is rotatably supported by means of a pair of bearings 27*a* at an outer circumference of the support member 22. The sheave 27 is provided with grooves 28 on an outer periphery thereof to be wound by a rope 29 (FIG. 2), and is provided with a predetermined number of internal teeth at an inner periphery thereof. A plurality of external teethed gears 60 are engaged at their inner circumferences with a crank portion 21*a* of the input shaft 21 by bearings 20*b*, each of which has a predetermined number of teeth on its outer circumference. A plurality of support shafts 24 are supported by the support member 22 at their opposite ends 24*b*, 24*c* by bearings 24*a*, and support a plurality of the external teethed gears 60 by bearings 24*e* at their crank portions 24*d*.

The internal teeth of the sheave 27 are constructed of a plurality of pins 26 and a plurality of cylindrical members 25 inserted into a plurality of the pins 26. The support member 22 is made up of one disc member having a plurality of posts 22*a* idly inserted into the external teethed gears 60, and the other disc member 22*b*. Both the disc members are connected to each other by means of a bolt 22*c*.

The sheave 27 rotates concentrically with the input shaft 21 with the reduced rotation transmitted from the input shaft 21. The rope 29 is connected to an ascending and descending cage 52 (FIG. 2) of the elevator and a balance weight 56 (FIG. 2) respectively in a manner described below, to move the ascending and descending cage 52 upward and downward.

The brake assembly 30 includes an intermediate member 31 in a cylindrical shape which is provided with an axial groove 31*a* on its outer circumference and splinedly coupled to the outer periphery of the input shaft 21, a pair of brake plates 32, 33 which are engaged with the axial groove 31*a* so as to be movable in an axial direction relative to the intermediate member 31 but rotatable integrally with the intermediate member 31, stationary walls 34, 35 which are arranged on opposite sides of the brake plates 32, 33 in an axial direction and held in a fixed state with respect to the housing 11, armatures 36, 37 disposed between the brake plates 32, 33 and movable to be drawn near or separated apart with respect to the stationary walls 34, 35, springs 38, 39 for respectively biasing the brake plates 32, 33 against the adjacent stationary walls 34, 35, and an electromagnet 40 fixedly arranged between the armatures 36, 37. A rotary portion of the encoder 16 is connected to the intermediate member 31, and a stationary portion of the encoder 16 is fixed to an inner wall of the housing 11.

Figure 2A:
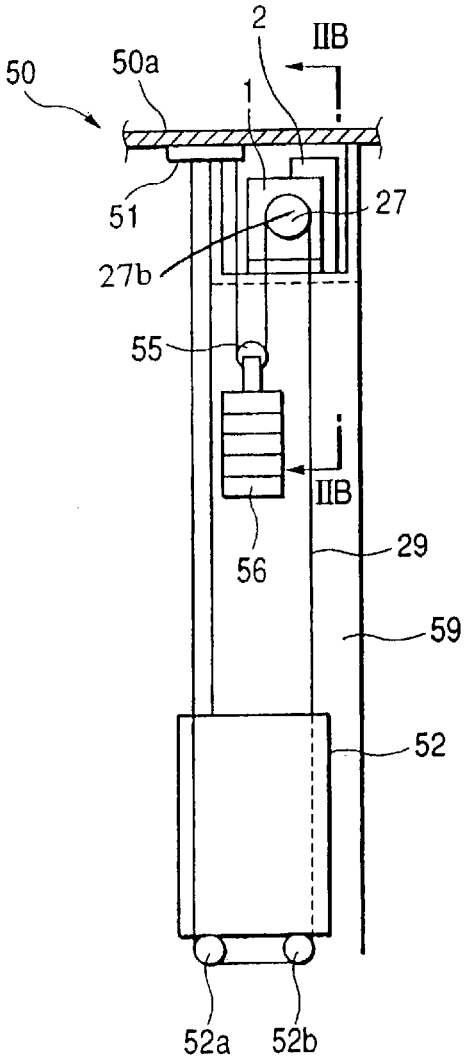
FIG. 2(*a*) is a view illustrating a state in which the actuating device 1 in FIG. 1 is disposed within a building 50, and FIG. 2(*b*) is a sectional view of the building 50 taken along a line IIB—IIB of FIG. 2(*a*).
Figure 2B:
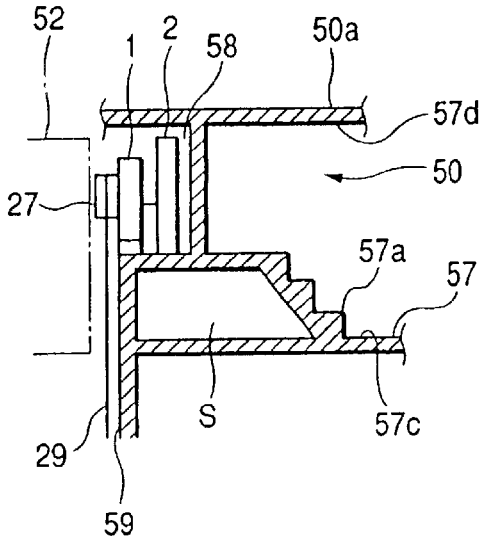

FIG. 2(*a*) is a view illustrating a state in which the actuating device 1 in FIG. 1 is disposed within the building 50, and FIG. 2(*b*) is a sectional view of the building 50 taken along a line IIB—IIB of FIG. 2(*a*). There are shown only a rooftop 50*a* and an uppermost floor (top floor) 57 of the building 50. Below the rooftop 50*a* of the building 50, is shown an ascending and descending cage 52 which is hung by means of the rope 29 and movable upward and downward along a guide which is not shown.

One end of the rope 29 is attached to a fitting portion 51 provided on a lower face of the rooftop 50*a*. The rope 29 is wound around pulleys 52*a*, 52*b* provided on a lower face of the ascending and descending cage 52 to be directed upward, wound around the sheave 27 of the actuating device 1 to be directed downward, then, wound around a pulley 55 supporting the balance weight 56 to be directed upward, and finally attached to the fitting portion 51 at its other end.

As shown in FIG. 2(*b*), inside the building 50, is provided the elevator passage 59 extending in a vertical direction, and the ascending and descending cage 52 is movably disposed along the elevator passage 59. There is provided a machine room 58 on the top floor 57 of the building 50 facing with the elevator passage 59. The actuating device 1 is arranged in the machine room 58 in such a manner that the outer periphery of the sheave 27 is positioned above the rope 29 in a vertical direction. A control panel 2 including its control unit is also disposed adjacent to the actuating device 1. The machine room 58 has a height which is slightly higher than a height of an operator, that is, the height to such an extent that the operator can work inside the room without bending his body. The height of the machine room 58 is smaller than a distance from a floor 57*c* to a ceiling 57*d* of the top floor 57. When the operator conducts an installation work or a maintenance work of the actuating device 1, he can ascend stairs 57*a* from the top floor 57 to a front of the machine room 58, and enter into the machine room 58 opening a door (not shown), thus providing a good access to the actuating device 1 and excellent workability. Since a door (not shown) of the ascending and descending cage 52 is adapted to be opened on the left hand or right hand in FIG. 2(*a*), the actuating device 1 will not be an obstacle for going in and out of the elevator. Moreover, the operator can move from the ascending and descending cage 52 or from a ceiling of the ascending and descending cage 52 to the machine room 58.

Next, drive and control of the ascending and descending cage 52 of the elevator by the actuating device 1 according to this embodiment will be described. At first, the motor assembly 10 in FIG. 1 is actuated by a signal from the control section (not shown) to rotate the input shaft 21 together with the rotor 14. Through the crank portion 21*a* of he input shaft 21, the external teethed gears 60 initiate eccentric swinging motions thus to cause the reduced rotation of the sheave 27 which has the internal teeth in mesh with the external teeth of the gears 60. Such reduction motion has been known. This rotation of the sheave 27 actuates the rope 29 which is wound in the grooves 28 on the outer periphery of the sheave, thereby to move the ascending and descending cage of the elevator upward and downward. The rotation of the input shaft 21 is reduced through the speed-reducer 20 at a determined ratio to be transmitted to the sheave 27, which rotates at a constant rotation speed.

During the operation of the motor assembly 10, electric power is supplied to the electromagnet 40 of the brake assembly 30, and the electromagnet 40 attracts the armatures 36, 37. When the armatures 36, 37 are attracted and move in a direction of approaching to each other, the springs 38, 39 are pushed by the armatures 36, 37 to contract. Thus, the brake plates 32, 33 are released from the biasing forces of the springs 38, 39 and separated from the stationary walls 34, 35 to put the intermediate member 31 in a rotatable condition, thereby maintaining a state in which the input shaft 21 is not applied with the braking force.

On the other hand, when the electric supply from the non-shown control unit is suspended (including a power failure), the electromagnet 40 will no more attract the armatures 36, 37. Therefore, the brake plates 32, 33 are pressed against the stationary walls 34, 35 with strong biasing forces of the springs 38, 39 through the armatures 36, 37. On this occasion, since large friction forces are exerted between the stationary walls 34, 35 and the brake plates 32, 33, a braking force can be applied to the input shaft 21 through the intermediate member 31 based on these friction forces. This causes the sheave 27 to stop the rotation.

According to the embodiment of the invention, as shown in FIG. 2(*b*), the ascending and descending cage 52 which has arrived at the top floor 57 (shown by an alternate long and short dash line) and the sheave 27 are laterally separated from each other. The sheave 27 has a rotation surface 27*b* (FIG. 2(*a*)), generally perpendicular to an axis of rotation of the sheave 27 and opposed to a side of the ascending and descending cage 52 when the ascending and descending cage 52 is positioned at the top floor 57. The ascending and descending cage 52 can approach to the ceiling 57*d* leaving the least allowable space for the overrun. Therefore, there is no need of providing the rope pulleys, the deflecting sheaves or the like in the upper part of the elevator passage 59, and so, the structure will be simplified and the overall height of the building 50 will not be unnecessarily increased. The allowable space for the overrun means a space formed between the ceiling 57*d* and an upper face of the ascending and descending cage 52 at its ordinary stopping position, in order to avoid a collision of the ascending and descending cage 52 with the ceiling 57*d* when it has overrun upward.

Because the output rotary wheel itself of the speed-reducer 20 constitutes the sheave 27 around which the rope 29 is wound, and at the same time, both the motor assembly 10 and the brake assembly 30 are provided on a same plane which is at right angle with the input shaft 21, this actuating device can be designed to be thin in an axial direction of the input shaft 21 as compared with the conventional actuating device. As described, because the actuating device 1 can be designed to be thin and compact, there is no need of providing the large-sized machine room on the top floor of the building 50 as in the conventional case, but the small machine room 58 will be sufficient to be provided. Therefore, a relatively large space S such as a storage can be provided below the machine room 58 as shown in FIG. 2(*b*), and an effective use of the space on the top floor 57 can be attained.

Although the invention has been described referring to the embodiment hereinabove, the invention is not limited to the embodiment, but various modifications are possible within a scope of technical concept of the invention. For example, the space S and the stairs 57*a* are provided in the above described embodiment, and the machine room 58 is defined between a floor above the space S and the ceiling 57*d*. However, the actuating device 1 may be installed on the floor 57*c* of the top floor 57, instead of providing the space S and the stairs 57*a*, to define the machine room 58 between the floor 57*c* and the ceiling 57*d* of the top floor. Further, the structure as shown in this embodiment is simply one example of the actuating devices, and the actuating device is not limited to the structure as shown in the described embodiment.

According to the elevator apparatus of the invention, because the actuating device is installed in the machine room provided on the top floor of the building in which the ascending and descending cage is disposed, and the machine room faces with the elevator passage for the ascending and descending cage, the elevator apparatus can be constructed in a smaller space and composed of less components, without employing the rope pulleys or the deflecting sheaves as in the prior art. Accordingly, the cost can be lowered. It is no more necessary that the ceiling of the top floor is set high unnecessarily. Further, because the height of the machine room is low, the effective space on the top floor of the building can be secured.

What is claimed is:

1. An elevator apparatus comprising:

a cage;

an elevator passage in which said cage is moved ascendingly and descendingly;

a machine room adjacent a top of said elevator passage, wherein the machine room is located in a top floor of a building having a ceiling, the ceiling lying substantially in the same plane as an upper limit of said elevator passage;

an actuating device including a sheave around which a rope engaged with the cage is wound and a motor assembly for rotating said sheave, wherein said motor assembly is mounted in said machine room so that said sheave is projected into said elevator passage; and a rotation surface of said sheave is generally perpendicular to an axis of rotation of said sheave and opposed to a side of said cage when said cage is positioned at said top of said elevator passage.

2. The elevator apparatus according to claim 1, wherein said actuating device includes a support member, a speed-reducer mounted on a first side of said support member, the motor assembly mounted on a second side of said support member, said second side being opposite from said first side.

3. The elevator apparatus according to claim 2, wherein an output wheel of said speed-reducer constitutes said sheave.

4. The elevator apparatus according to claim 2, wherein said support member is attached to a floor surface of said machine room.

5. The elevator apparatus according to claim 1, wherein a brake assembly is provided between an elevator passage side axial end plane of said sheave and a machine room side end plane of said motor assembly.

6. The elevator apparatus according to claim 5, wherein said speed-reducer, said motor assembly and said brake assembly are arranged coaxially to one another.

7. The elevator apparatus according to claim 5, wherein said brake assembly is arranged radially inwardly of said motor assembly.

8. The elevator apparatus according to claim 1, wherein said motor assembly includes:

a rotary disc extending radially;

a ring extended from an outer circumference of said rotary disc on an outer surface of which permanent magnets are attached so as to constitute a rotor; and a stator arranged radially outwardly of said ring.

9. The elevator apparatus according to claim 8, further comprising an encoder arranged at a center of a space formed inside of said ring.

10. The elevator apparatus according to claim 1, wherein said motor assembly includes a rotary disc extending radially, and a rotor being fixed to an outer circumference of said rotary disc; and said actuating device further includes a support member positioned in facing relationship to a web of said rotary disc.

11. The elevator apparatus of claim 10, wherein said support member rotationally supports said sheave.

12. The elevator apparatus according to claim 10, wherein said support member includes a first support member on which a plurality of columnar parts project, and a second support member fixed to said columnar parts; and said sheave is rotationally supported by said first support member and said second support member.

13. The elevator apparatus according to claim 12, wherein each of said rotary elements is accommodated in a space defined between said first and second support members.

14. The elevator apparatus according to claim 1, wherein a speed-reducer is arranged radially inwardly of said sheave.

15. The elevator apparatus according to claim 1, wherein said motor assembly rotatably drives an input shaft;

a speed-reducer including rotary elements, each contacting a circumferential surface of said input shaft such that the rotary elements rotate as said input shaft rotates; and a cylindrical element having an inner circumferential surface contacting said rotary elements to rotate as said rotary elements rotate.

16. The elevator apparatus according to claim 15, wherein said speed-reducer further includes intermediate shafts that rotatably support said rotary elements, respectively, and that are supported by said support member.

17. The elevator apparatus according to claim 16, wherein each of said intermediate shafts has axial ends supported by said support member.

18. The elevator apparatus according to claim 1, wherein a speed-reducer and said motor assembly are mounted on a single input shaft, so as to be adjacent to each other.

19. The elevator apparatus according to claim 18, wherein said rotary elements, said cylindrical element and said sheave are arranged on and along the same plane.

20. The elevator apparatus according to claim 5, wherein said brake assembly is arranged radially inwardly of said motor assembly.

21. The elevator apparatus according to claim 1, wherein a sectional area of said machine room defined along a horizontal direction is smaller than a sectional area of said machine room defined along a vertical direction perpendicular to the axis of rotation of said sheave.

22. The elevator apparatus according to claim 1, wherein a width of said actuating device is smaller than an outer diameter of said sheave.

* * * * *